US005360357A

United States Patent [19]

Drake et al.

[11] Patent Number: 5,360,357

[45] Date of Patent: Nov. 1, 1994

[54] SELF-PROPELLED WATERCRAFT

[75] Inventors: James R. Drake, Santa Monica; Kuniyuki Hayashi, Long Beach, both of Calif.

[73] Assignee: Yamaha Hatsudoko Kabushiki Kaisha, Iwata, Japan

[21] Appl. No.: 880,225

[22] Filed: May 8, 1992

Related U.S. Application Data

[63] Continuation-in-part of Ser. No. 744,362, Aug. 13, 1991, abandoned.

[51] Int. Cl.[5] ..... B63H 1/36

[52] U.S. Cl. ..... 440/14; 440/20; 440/104; 440/106; 114/61; 114/363

[58] Field of Search ..... 440/13, 14, 15, 17, 440/20, 101, 104, 106, 105, 107; 114/61, 363

[56] References Cited

U.S. PATENT DOCUMENTS

| | | | |
|---|---|---|---|
| 1,484,719 | 2/1924 | Koch | 440/107 |
| 2,097,931 | 11/1937 | Martin | 440/14 |
| 2,995,763 | 8/1961 | Rounds | 440/107 |
| 3,142,286 | 7/1964 | Ritter | 440/20 |
| 3,585,955 | 6/1971 | Cella | 114/61 X |
| 3,834,343 | 9/1974 | Hopkins | 440/14 |
| 3,880,107 | 4/1975 | Miles | 440/14 |
| 4,442,787 | 4/1984 | Curran et al. | 114/363 |
| 4,813,366 | 3/1989 | Elder | 114/363 X |

*Primary Examiner*—Sherman Basinger

*Attorney, Agent, or Firm*—Knobbe, Martens, Olson & Bear

[57] ABSTRACT

A small self-propelled watercraft having a main hull and an outrigger hull that is powered by a fin like oar arrangement. The main hull seats the rider and provides the substantial portion of the buoyancy for the watercraft. The fin like oar arrangement includes a blade type fin that is supported for pivotal movement at the end of the oar and the degree of pivotal movement can be adjusted from the handle end of the oar. In addition, the fin like blade is supported for movement between forward and reverse thrust positions and this movement is also controlled at the handle of the oar.

61 Claims, 4 Drawing Sheets

SELF-PROPELLED WATERCRAFT

CROSS-REFERENCE TO RELATED APPLICATION

This application is a continuation-in-part of our copending application of the same title, Ser. No. 744,362, filed Aug. 13, 1991, and assigned to the Assignee hereof.

BACKGROUND OF THE INVENTION

This invention relates to a self-propelled watercraft and more particularly to an improved, high utility high speed self-propelled watercraft.

A wide variety of watercraft have been proposed for varying purposes. Although power or sail propelled watercraft have certain advantages, they also have some disadvantages. In many regards, self-propelled watercraft can offer greater satisfaction for the user than watercraft that are propelled either by motors or sails. However, the type of self-propelled watercraft previously employed, such as canoes, outrigger canoes, kayaks and sea kayaks have had some disadvantages. There is a particular need for a small self-propelled watercraft that can be employed in a wide variety of conditions such as shallow water and channels which may be chocked with weeds and in addition in open water such as the ocean or large seas. However, the prior art watercraft used in an open ocean and which have offered high degrees of stability and speed have been propelled by many individuals and have been quite large.

It is, therefore, a principal object of this invention to provide an improved small self-propelled watercraft than can be utilized in a wide variety of waters and water conditions.

It is a further object of this invention to provide an improved small self-propelled watercraft of this type which can be easily knocked down and transported and which is light in weight and easily manipulated.

It is a further object of this invention to provide an improved light weight small self-propelled watercraft of the outrigger type propelled by a single fin like oar.

With a watercraft powered by a single fin like oar, the oar normally embodies an oar element having a fin that is pivotally supported at its outer end and which acts like the tail of a fish as the oar is pivoted back and forth in its oarlock. The amount of pivotal movement of the fin relative to the oar element will govern the efficiency of the oar in its operation. Many times, it is desirable to provide some adjustment in the amount of pivotal movement of the fin. However, it is disadvantageous if the operator must stop the watercraft and move to the rear end of the oar element where the fin is positioned to provide such an adjustment.

It is, therefore, a further object to this invention to provide an improved arrangement for adjusting the pivotal range of movement of the fin from the oar handle and while the oar is being stroked back and forth.

It has also been found that the efficiency of this type of oar can be significantly improved if the only portion which is submerged in the body of water in which the watercraft is operating is the fin like blade.

It is, therefore, a still further object to this invention to provide an improved oar of this type wherein the oar includes an arrangement which precludes anything more than the fin being submerged in the body of water in which the oar is operating.

As is well known, boats with conventional oars may be rowed either in forward or reverse directions. However, with a fin like oar of the type described, it is not possible with conventional constructions to permit rowing in a reverse direction.

It is, therefore, a still further object to this invention to provide an improved fin type of oar wherein the fin may be pivoted between a forward rowing position and a rearward rowing position from the handle and while the oar is being operated.

There is a particular advantage in operating an oar of this type if the oarlock is mounted on a carriage that is slidably supported transversely across the watercraft. This type of arrangement permits very efficient and very effective rowing. However, with conventional structures the operator must exert the full force on the oar to move it in either direction.

It is, therefore, a still further object to this invention to provide an improved arrangement incorporating a spring for storing energy during the stroking motion in one direction to relieve the operator from some of the rowing force in the reverse direction of movement.

It has also been proposed to provide a moveable foot rest that is connected to the oarlock so that the operator may use his leg motion also to move the oar lock during the rowing motion. However, it is also desirable to permit the user to adjust his foot position on the oarlock support.

It is, therefore, a still further object to this invention to provide an improved arrangement for supporting an oar of this type and permitting the rider to adjust his foot position.

SUMMARY OF THE INVENTION

A first feature of this invention is adapted to be embodied in a self-propelled watercraft having an elongated main hull, an outrigger hull carried at one side of the main hull and a seat on the main hull facing the outrigger hull. An oar is supported for pivotal movement about a generally vertically extending axis between the main and outrigger hulls and has a handle accessible by an operator seated on the seat for propelling the watercraft.

Another feature of this invention is adapted to be embodied in a fin type oar for propelling a watercraft which comprises an oar element having a handle end and a fin end. An oarlock supports the oar for pivotal movement between its ends about a first upstanding pivotal axis. A blade type fin is supported for pivotal movement about a second upstanding pivotal axis at the blade end of the oar element. Means are accessible at the handle end of the oar element for limiting the pivotal movement of the blade type fin about the second pivotal axis upon a stroking motion of the oar.

Another feature of the invention is adapted to be embodied in a fin type oar for propelling a watercraft comprising an oar element having a handle end and a fin end. An oarlock supports the oar for pivotal movement between its ends about a first upstanding pivot axis and a blade type fin is supported for pivotal movement about a second upstanding pivotal axis at the blade end of the oar element. Means are incorporated for limiting the movement of the oar element other than the fin relative to the oarlock so as to preclude any portion of the oar element from becoming immersed in the body of water in which the oar is operating.

Yet another feature of the invention is adapted to be embodied in a fin type oar for propelling a watercraft comprising an oar element having a handle end and a fin end. An oarlock supports the oar for pivotal movement between its ends about a first upstanding pivot axis. A blade type fin is supported for pivotal movement about a second upstanding pivotal axis at the blade end of the oar element. The blade type fin is offset relative to the second pivotal axis and means are accessible at the handle end of the oar element for moving the blade type fin from a first position wherein the watercraft will be propelled in a forward direction upon pivotal movement of the oar element and a second position wherein the watercraft will be propelled rearwardly upon pivotal movement of the oar element.

Another feature of the invention is adapted to be embodied in a self-propelled watercraft having an elongated main hull and an outrigger hull carried at one side of the main hull. A seat is positioned on the main hull facing the outrigger hull. An oar is supported for pivotal movement about a generally vertically extending axis on an oarlock which is supported for transverse movement across the watercraft in the area between the main hulls and the outrigger hulls upon its stroking motion. The oar has a handle accessible by an operator, seated on the seat, for propelling the watercraft. Biasing means bias the oar support toward one of the hulls.

DETAILED DESCRIPTION OF THE PREFERRED EMBODIMENT OF THE INVENTION

Figure 1:
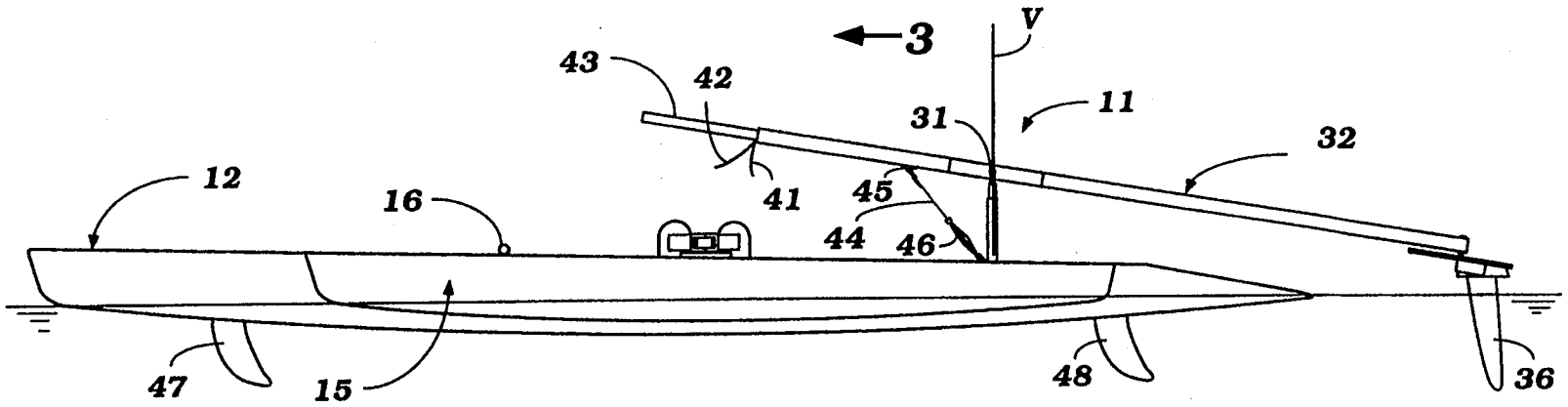
FIG. 1 is a side elevational view of a small self-propelled watercraft constructed in accordance with an embodiment of the invention.
Figure 2:
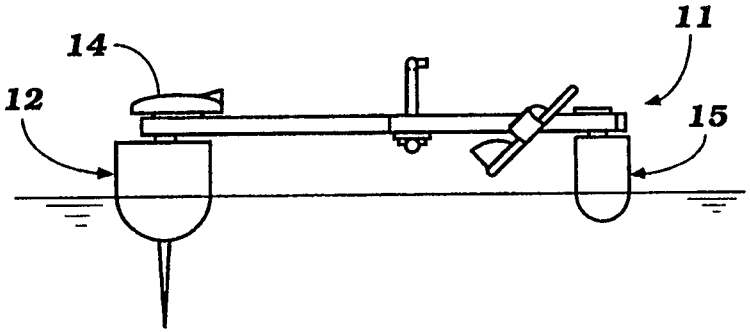
FIG. 2 is an end elevational view thereof.

Referring now in detail to the drawings, a small self-propelled watercraft constructed in accordance with an embodiment of the invention is identified generally by the reference numeral 11. The watercraft 11 is comprised of an elongated generally tapered main hull, indicated generally by the reference numeral 12 which may be formed from a suitable material such as a molded fiberglass reinforced resin. In a preferred embodiment of the invention, the main hull 12 has a generally hollow configuration the ends of which may be sealed by internal bulkheads and which may be filled with a flotation material such as a foamed plastic if desired. The center portion of the main hull 12 is generally open and provides one or more storage compartments which may be segmented from each other and which are accessible through hatch covers 13. This storage capability of the main hull provides storage for camping goods such as food, clothing, tents or the like.

A seat 14 is mounted on the main hull 12 in a manner to be described between the hatch covers 13 and faces sidewardly, for a reason to be described.

The watercraft 11 also includes an outrigger hull, indicated generally by the reference numeral 15, which also may be formed from a suitable material such as a molded fiberglass reinforced resin and which also is hollow. Of course other light weight mateial such as composites my be employed. This outrigger hull 15 also may be provided either with a storage area accessible through a hatch cover or, alternatively, may be filled with a foam like floatation material.

In accordance with an important feature of the design, the outrigger hull 15 is provided mainly for stability and is substantially shorter in length than the main hull 12. The larger percentage (more than 50%) of the buoyancy of the entire watercraft 11 is provided by the main hull 12 since the rider or operator has substantially all of his weight located over the main hull 12. In a preferred embodiment of the invention, 80% of the total buoyancy of the watercraft may be provided by the main hull 12.

In a specific embodiment of the invention, the main hull may be sixteen feet long, a reasonable maximum length to easily be carried on the roof of an automobile with approximately a ten inch maximum width with a length to beam ratio of twenty. The outrigger hull, on the other hand, is approximately ten feet long and six inches wide with a length to beam ratio of twenty. Of course, these dimensions are only examples of a preferred form in which the invention may take.

The outrigger hull 15 is connected to the main hull 12 by means including a pair of spaced apart cross beams 16. The cross beams 16 are received in tubular supports 17 and 18 affixed to the main and outrigger hulls 12 and 15, respectively. Suitable clamping mechanisms are provided for maintaining the cross beams 16 in place and holding the main hull 12 and outrigger hull 15 in their desired relationship.

Figures 4, 5:
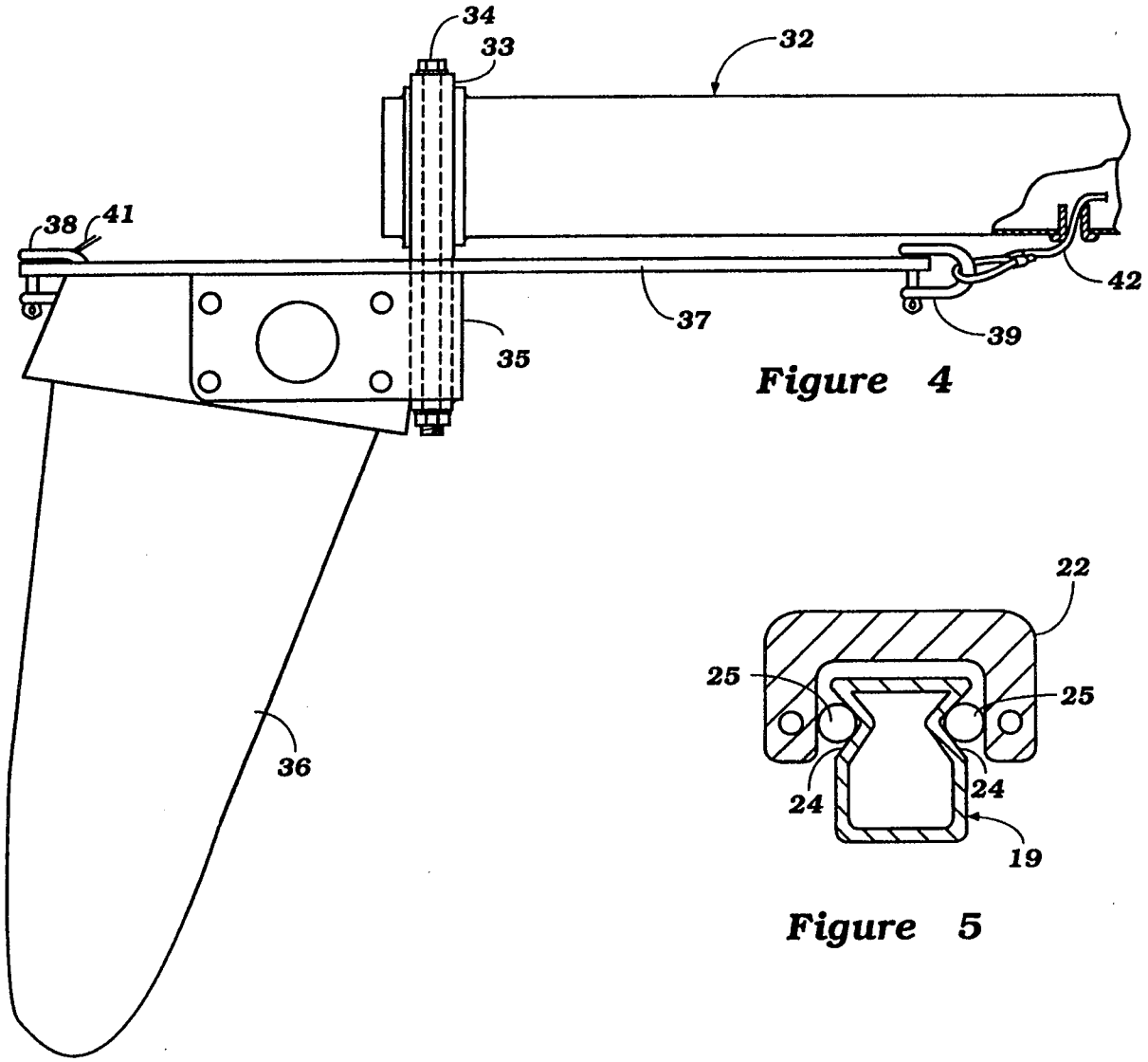
FIG. 4 is an enlarged side elevational view of the fin end of the oar showing the fin blade in its forward rowing position.
FIG. 5 is a cross sectional view taken along the line 5—5 of FIG. 3 and shows the support for the carriage.

A propulsion system is provided for propelling the watercraft 11 by the operator seated on the seat 14 and this propulsion mechanism includes a monorail 19 having a cross sectional configuration as shown in FIG. 5 and which extends transversely across the area between the cross beams 16 and in proximity to the seat 14. The monorail 19 may be conveniently formed as an aluminum extrusion and carries the seat 14. The monorail is detachably affixed to the main hull 12 by means of a connector like that which will be described in the connection between the monorail 19 and the outrigger hull 15.

Figure 3:
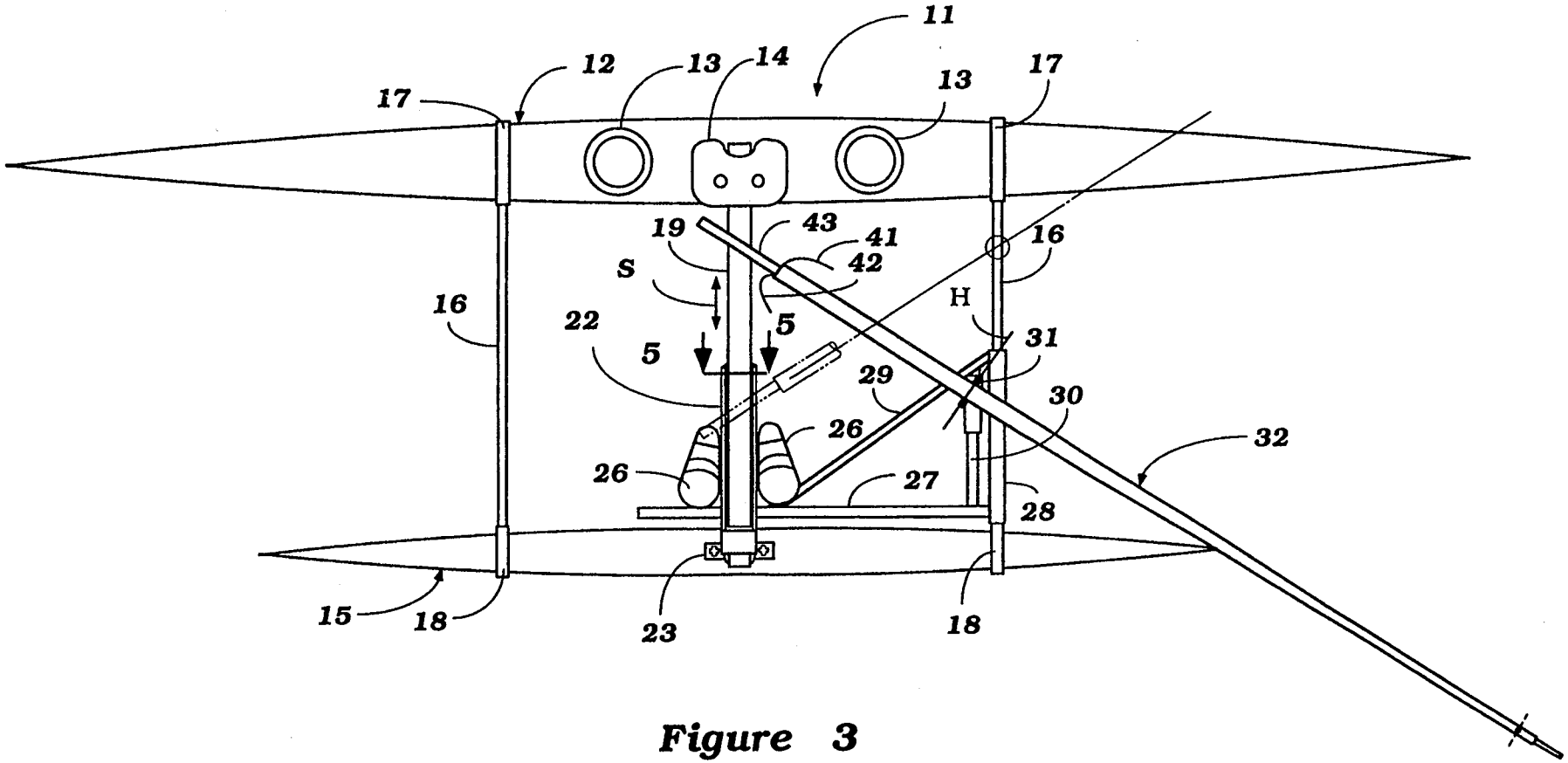
FIG. 3 is a top plan view thereof.

A carriage 22 is slidably supported on the monorail 19 so that it can move transversely from adjacent the main hull 12 to adjacent the outrigger hull 15, the latter position being shown in FIG. 3. The monorail 19 is fixed to the outrigger hull 15 by means of an attaching mechanism 23 that is comprised of a bracket and fasteners.

As may been seen in FIG. 5, the monorail 19 has a pair of grooves 24 formed in its opposite sides. The carriage 22 has a recirculating ball bearing arrangement including ball bearings 25 that are trapped within the grooves 24 and which provide a sliding support for the carriage 22 along the monorail 19. This support is extremely effective for resisting the torques which are generated during the rowing of the oar, to be described.

The monorail 19 is located in the vicinity of the center of buoyancy of the main and outrigger hulls 12 and 15 and the carriage 22 is provided with a pair of stretchers or foot rests 26 onto which the rider may place his feet. These stretchers 26 may be rigidly affixed to the carriage 22 or may be adjustable for length along the carriage so as to suit different stature riders and also at different pivotal angles relative to the carriage 22.

A rigger 27 is affixed to the end of the carriage 22 adjacent of the stretchers 26 and is connected thereto in any suitable manner. The opposite end of the rigger 27 is provided with a tubular portion 28 which is slidable on one of the cross beams 16. A cross-stay 29 extends between the opposite end of the rigger 27 and the tubular portion 28 for stiffening purposes.

A further cross piece 30 extends between .the rigger 27 and stay 29 carries an oarlock 31 that is pivotally supported about a vertically extending pivot axis V (FIG. 1) and which receives an oar assembly, indicated generally by the reference numeral 32. This oar assembly 32 is formed from a hollow tubular construction which has fixed to it centrally a sleeve (not shown) carrying a collar (not shown) to provide an interlocking relationship with the oarlock 31 while permitting the oar assembly 32 to pivot about a horizontally extending axis, as with conventional oarlock assemblies. This horizontal axis is illustrated by the line H in FIG. 3.

The trailing or blade end of the oar assembly 32 (FIGS. 4, 6 and 7) has a bearing 33 that carries a pivot shaft 34. A blade holder 35 is journaled on the pivot shaft 34 and carries a blade 36. A blade control arm 37 extends across the upper portion of the blade carrier 35 and carries a pair of attachments 38 and 39 which are adapted to receive respective control ropes 41 and 42. These control ropes extend through the hollow interior of the tubular portion of the oar 32 and terminate adjacent a handle portion 43 that is accessible to an operator seated on the seat 14.

Figure 6:
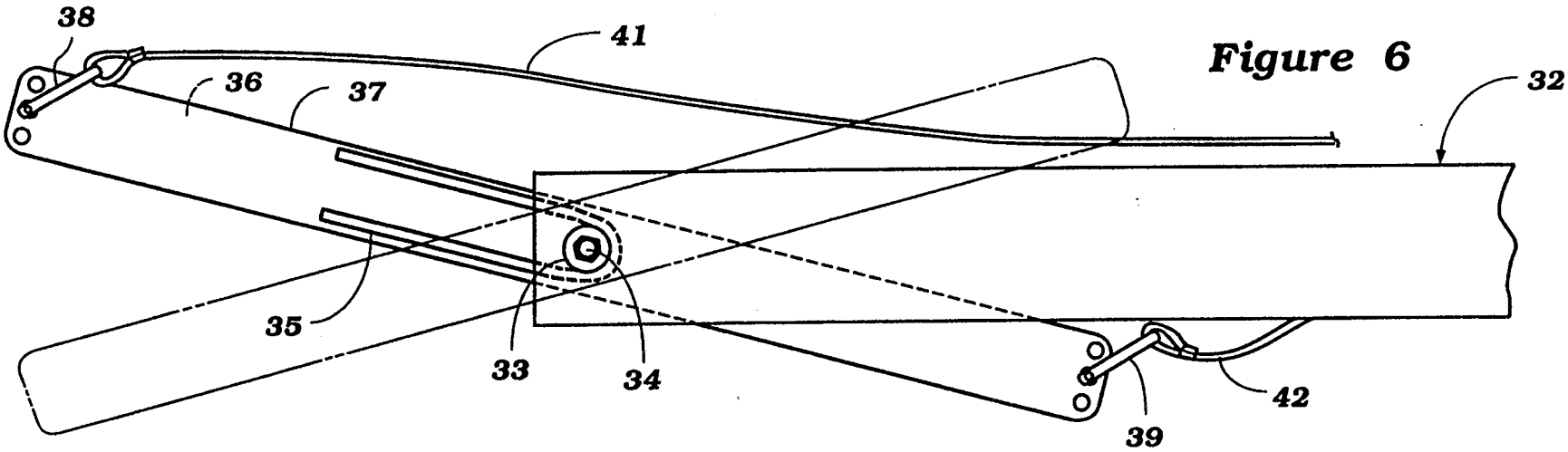
FIG. 6 is a top plan view of the oar portion shown in FIG. 4 and shows how the pivotal movement of the oar can be controlled in the forward rowing direction.

The control rope 42 limits the degree of pivotal movement of the blade 36 upon stroking motion as may be seen in FIG. 6. By changing the pivotal movement of the blade 36 relative to the pivot axis 34 different rowing efficiencies may be achieved to optimize the performance.

Figure 7:
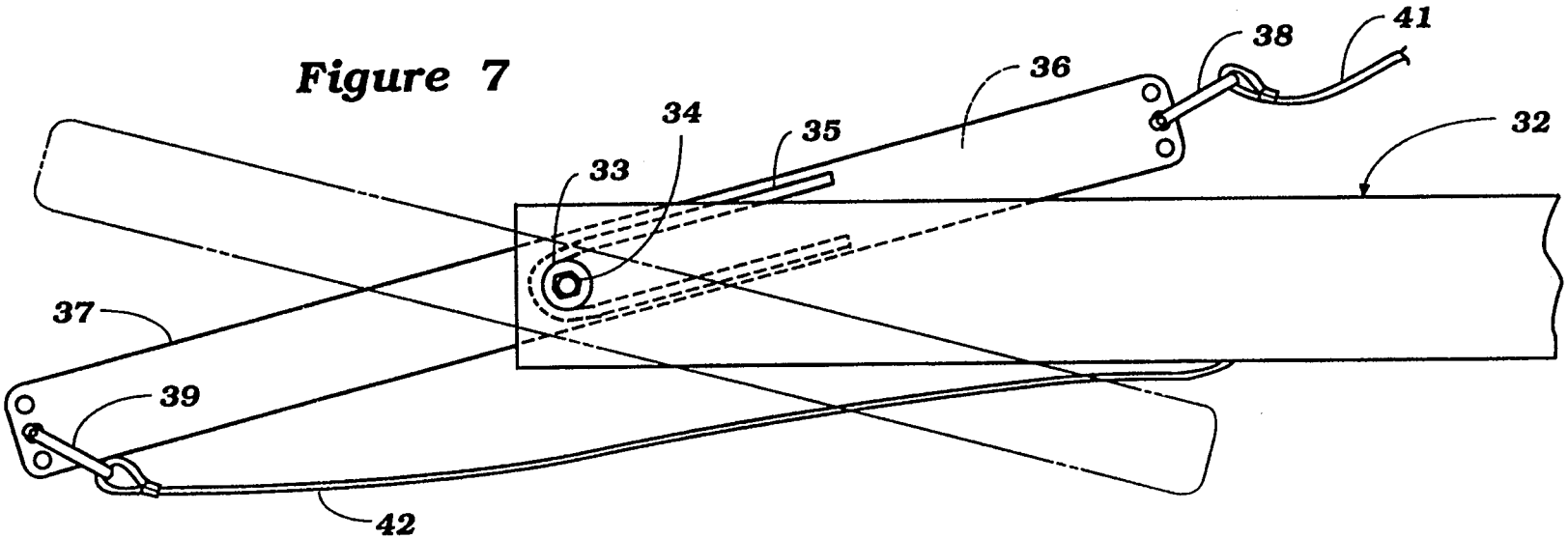
FIG. 7 is a top plan view, in part similar to FIG. 6, and shows the condition in the reverse rowing mode.

In addition, the blade 36 may be pivoted from the position shown in FIGS. 4 and 6 to the position shown in FIG. 7 by pulling of the control rope 41. When this occurs, the blade 36 will be in a reverse mode and the watercraft 11 may then be in a reverse direction. Under this condition, the rope 42 controls again the amount of pivotal movement of the blade 36 and, accordingly, its efficiency.

During this rowing operation, the blade 36 operates like the tail of a fish and will provide a very high propulsive force to the watercraft 11.

It is also been found that the efficiency can be significantly improved if only the blade portion 36 of the oar assembly 32 is immersed in the water. To accomplish this, a cable assembly 44 (FIG. 1) is affixed to an eyelet 45 formed on the oar assembly 32 adjacent the handle 43 and by means of a turnbuckle 46 to the base of the oarlock 31. As may be readily seen in FIG. 1, the cable 44 and turnbuckle 46 will limit the degree to which the blade 36 may be submersed in the body of water in which the watercraft is operating without adversely affecting the ability of the operator to raise the blade 36 out of water. Adjustment may be made by changing the position of the turnbuckle 46 as should be readily apparent.

The solid line view of FIG. 3 shows the position of the oar 32 at the completion of the stroke in one direction during which the oar 32 rotates in a clockwise direction about the pivotal axis of the oarlock 31. During this motion, the blade 36 will be disposed at an angle on the opposite side of the main oar portion 32 from the position shown in FIGS. 3 and 6. This condition shown in FIG. 3 will occur when the oar is pushed outwardly to the phantom line position as shown in FIG. 3. During this motion, the carriage 22 and rigger 27 move to toward the main hull 12 and the final position is shown by the phantom circle in FIG. 3. A biasing spring which is represented by the double-headed arrow S in FIG. 3 is incorporated for moving the carriage 22 to one of these positions to reduce riders effort.

As a result of this type of oar action, a propulsion stroke will be generated by each pivotal movement of the oar 32 and, as noted, the propulsion is like that of a fish. In addition, the watercraft 11 can be easily steered by the operator's control of the motion of the oar 32. Also, the angle through which the fin or blade 36 moves can be adjusted by changing the length of the aforenoted rope 42 and reverse action may be achieved by the rope 41, both of which are accessible by an operator while still seated on the seat 14.

The oar 32 also has a swept back angle in side view so as to avoid the likelihood of any damage in the event of a crash, during beaching, and to easily pass over underwater vegetation.

For stability purposes, front and/or rear skegs 47 and 48 may be affixed to the main hull 12 so as to reduce yawing oscillation and lessen the energy loss by yawing. The skegs 47 and 48 also will produce some thrust. For ease of transportation, the skegs 47 and 48 are detachably connected to the main hull 12 and the main hull 12 may be provided with suitable receptacles so as to receive blades at the upper ends of skegs 47 and 48 for installation and removal.

It should be readily apparent that the watercraft 11 as described provides a very stable high speed watercraft which can be operated in rough seas and large bodies of water and still, at the same time is capable of use in shallow streams and weed infested water. Furthermore, the knockdown construction of the watercraft 11 permits it to be easily transported from place to place and stored. Of course, the foregoing description is that of a preferred embodiment of the invention and various changes and modifications may be made without departing from the spirit and scope of the invention, as defined by the appended claims.

We claim:

1. A fin type oar propelling a watercraft comprising an oar element having a handle end and a blade end, an oarlock supporting said oar element for pivotal movement between its ends about a first upstanding pivot axis and for pivotal movement relative to said oarlock about a horizontal axis which horizontal axis also pivots about said first upstanding axis with said oar element, a blade type fin supported for pivotal movement about a second upstanding pivotal axis at said blade end of said oar element, means accessible at the handle end of said oar element for limiting the degree of pivotal movement of said blade type fin about said second pivot axis upon stroking motion of said oar and means for limiting the pivotal movement of said oar element relative to the oarlock and said horizontal axis for controlling the degree of submersion of the blade type fin in the body of water in which the watercraft is operating.

2. A fin type oar for propelling a watercraft as set forth in claim 1 wherein the means for limiting the pivotal movement of the blade type fin about the second upstanding pivotal axis limits the degree of pivotal movement in each direction.

3. A fin type oar for propelling a watercraft as set forth in claim 2 wherein the means for limiting the pivotal movement about the second upstanding pivot axis comprises a rope extending to the handle end of the oar element.

4. A fin type oar for propelling a watercraft as set forth in claim 1 wherein the means for limiting the pivotal movement of the oar element about the horizontal axis relative to the oarlock comprises a flexible transmitter interconnected between the oar element and the oarlock.

5. A fin type oar for propelling a watercraft as set forth in claim 1 wherein the blade type fin is supported for movement between a first forward drive position for exerting forward thrust on the associated watercraft when said oar is rowed and a reverse position for exerted rearward thrust on the watercraft when said oar is rowed.

6. A fin type oar for propelling a watercraft as set forth in claim 5 further including means for moving said blade type fin between said forward and reverse positions and means for operating said means accessible at the handle end of said oar element.

7. A fin type oar for propelling a watercraft as set forth in claim 6 wherein the means for operating the blade type fin between its forward and reverse positions comprises a flexible transmitter accessible at the handle end of the oar element.

8. A fin type oar for propelling a watercraft as set forth in claim 7 wherein the means for limiting the pivotal movement of the blade type fin about the second upstanding pivotal axis limits the degree of pivotal movement in each direction.

9. A fin type oar for propelling a watercraft as set forth in claim 8 wherein the means for limiting the pivotal movement about the second upstanding pivot axis comprises a rope extending to the handle end of the oar element.

10. A fin type oar for propelling a watercraft as set forth in claim 9 wherein the means for limiting the pivotal movement of the oar element about the horizontal axis relative to the oarlock comprises a flexible transmitter interconnected between the oar element and the oarlock.

11. A watercraft comprising an elongated main hull, an outrigger hull carried at one side of said main hull, an oar element having a handle end and a blade end, an oarlock supporting said oar for pivotal movement between its ends about a first upstanding pivot axis, a blade type fin supported for pivotal movement about a second upstanding pivotal axis at said blade end of said oar element, means accessible at the handle end of said oar element for limiting the degree of pivotal movement of said blade type fin about said second pivot axis upon stroking motion of said oar, a seat on said man hull facing said outrigger hull and from which the handle end of the oar element is accessible by an operator seated on said seat, said oarlock being slidably supported for transverse movement across said watercraft in the area between said main and said outrigger hulls upon its stroking motion.

12. A watercraft as set forth in claim 11 wherein the sliding support for said oarlock comprises a carriage extending from an area beneath said seat transversely across said watercraft to said outrigger hull and carrying said oarlock.

13. A watercraft as set forth in claim 12 wherein the means for limiting the pivotal movement of the blade type fin about the second pivotal axis limits the degree of pivotal movement in each direction.

14. A watercraft as set forth in claim 13 wherein the means for limiting the pivotal movement comprises a rope extending to the handle end of the oar element.

15. A watercraft comprising an elongated main hull, an outrigger hull carried at one side of said main hull, an oar element having a handle end and a blade end, an oarlock supporting said oar for pivotal movement between its ends about a first upstanding pivot axis and for pivotal movement of said oar element relative to said oarlock about a horizontally extending axis, a blade type fin supported for pivotal movement about a second upstanding pivotal axis at said blade end of said oar element, means for limiting the degree of pivotal movement of said oar element relative to said oarlock about said horizontal pivot axis for controlling the degree of submersion of said blade type fin in the body of water in which the watercraft is operating, a seat on said main hull facing said outrigger hull and from which said handle end of said oar element is accessible by an operator seated on said seat, said oarlock being slidably supported for transverse movement across said watercraft in the area between said main and said outrigger hulls upon its stroking motion.

16. A watercraft as set forth in claim 15 wherein the means for limiting the pivotal movement of the oar element relative to the oarlock comprises a flexible transmitter interconnected between the oar element and the oarlock.

17. A watercraft as set forth in claim 16 wherein the sliding support for said oarlock comprises a carriage extending from an area beneath said seat transversely across said watercraft to said outrigger hull and carrying said oarlock.

18. A watercraft comprising an elongated main hull, an outrigger hull carried at one side of said main hull, an oar element having a handle end and a blade end, an oarlock supporting said oar for pivotal movement between its ends about a first upstanding pivot axis, a blade type fin supported for pivotal movement about a second upstanding pivot axis at the blade end of said oar element, said blade type fin being supported for movement between a first forward thrust position for exerting a forward thrust on the associated watercraft during stroking motion of said oar element and a reverse thrust position for exerting a reverse thrust on the watercraft during stroking motion of said oar element, and means accessible at the handle end of said oar element for moving said blade type fin between its forward and reverse thrust positions, a seat on said main hull facing said outrigger hull and from which said handle end of said oar element is accessible by an operator seated on said seat, said oarlock being slidably supported for transverse movement across said watercraft in the area between said main and said outrigger hulls upon its stroking motion.

19. A watercraft as set forth in claim 18 wherein the sliding support for said oarlock comprises a carriage extending from an area beneath said seat transversely across said watercraft to said outrigger hull and carrying said oarlock.

20. A fin type oar for propelling a watercraft as set forth in claim 19 further including means for moving said blade type fin between said forward and reverse positions and means for operating said means accessible at the handle end of said oar element.

21. A fin type oar for propelling a watercraft as set forth in claim 20 wherein the means for operating the blade type fin between its forward and reverse positions comprises a flexible transmitter accessible at the handle end of the oar element.

22. A self-propelled watercraft having an elongated main hull, an outrigger hull carried at one side of said main hull, a seat on said main hull facing said outrigger hull, an oarlock, an oar supported for pivotal movement about a generally vertically extending pivot axis by said oarlock between said main and said outrigger hulls, said oar having a handle accessible by an operator on said seat for propelling said watercraft, said oarlock being supported on a carriage extending from the area beneath said seat transversely across said watercraft toward said outrigger hull and supported for transverse movement across said watercraft upon stroking motion of said oar, and means for biasing said support toward one of said hulls.

23. A watercraft as set forth in claim 22 wherein the oar comprises an oar element having a handle end and a blade end, a blade type fin supported for pivotal movement about a second upstanding pivotal axis at said blade end of said oar element, and means accessible at the handle end of said oar element for limiting the degree of pivotal movement of said blade type fin about said second pivot axis upon stroking motion of said oar.

24. A watercraft as set forth in claim 23 wherein the means for limiting the pivotal movement of the blade type fin about the second pivotal axis limits the degree of pivotal movement in each direction.

25. A watercraft as set forth in claim 24 wherein the means for limiting the pivotal movement comprises a rope extending to the handle end of the oar element.

26. A watercraft as set forth in claim 23 further including means for limiting the pivotal movement of the oar element relative to the oarlock for controlling the degree of submersion of the blade type fin in the body of water in which the watercraft is operating.

27. A watercraft as set forth in claim 26 wherein the means for limiting the pivotal movement of the oar element relative to the oarlock comprises a flexible transmitter interconnected between the oar element and the oarlock.

28. A watercraft as set forth in claim 27 wherein the means for limiting the pivotal movement of the blade type fin about the second pivotal axis limits the degree of pivotal movement in each direction.

29. A watercraft as set forth in claim 28 wherein the means for limiting the pivotal movement comprises a rope extending to the handle end of the oar element.

30. A watercraft as set forth in claim 23 wherein the blade type fin is supported for movement between a first forward drive position for exerting forward thrust on said watercraft when said oar is rowed and a reverse position for exerted rearward thrust on the watercraft when said oar is rowed.

31. A watercraft as set forth in claim 30 further including means for moving said blade type fin between said forward and reverse positions and means for operating said means accessible at the handle end of said oar element.

32. A watercraft as set forth in claim 31 wherein the means for operating the blade type fin between its forward and reverse positions comprises a flexible transmitter accessible at the handle end of the oar element.

33. A watercraft as set forth in claim 32 wherein the means for limiting the pivotal movement of the blade type fin about the second pivotal axis limits the degree of pivotal movement in each direction.

34. A watercraft as set forth in claim 33 wherein the means for limiting the pivotal movement comprises a rope extending to the handle end of the oar element.

35. A watercraft as set forth in claim 34 further including means for limiting the pivotal movement of the oar element relative to the oarlock for controlling the degree of submersion of the blade type fin in the body of water in which the watercraft is operating.

36. A watercraft as set forth in claim 35 wherein the means for limiting the pivotal movement of the oar element relative to the oarlock comprises a flexible transmitter interconnected between the oar element and the oarlock.

37. A watercraft as set forth in claim 36 wherein the means for limiting the pivotal movement of the blade type fin about the second pivotal axis limits the degree of pivotal movement in each direction.

38. A watercraft as set forth in claim 37 wherein the means for limiting the pivotal movement comprises a rope extending to the handle end of the oar element.

39. A watercraft as set forth in claim 22 wherein the oar comprises an oar element having a handle end and a blade end, a blade type fin supported for pivotal movement about a second upstanding pivotal axis at said blade end of said oar element, and means for limiting the degree of pivotal movement of said oar element relative to said oarlock about said horizontal pivot axis for controlling the degree of submersion of said blade type fin in the body of water in which the watercraft is operating.

40. A watercraft as set forth in claim 39 wherein the means for limiting the pivotal movement of the oar element relative to the oarlock comprises a flexible transmitter interconnected between the oar element and the oarlock.

41. A watercraft as set forth in claim 22 wherein the oar comprises an oar element having a handle end and a blade end, a blade type fin element supported for pivotal movement about a second upstanding pivot axis at the blade end of said oar element, said blade type fin being supported for movement between a first forward thrust position for exerting a forward thrust on said watercraft during stroking motion of said oar element and a reverse thrust position for exerting a reverse thrust on said watercraft during stroking motion of said oar element, and means accessible at the handle end of said oar element for moving said blade type fin between its forward and reverse thrust positions.

42. A self-propelled watercraft having an elongated main hull, an outrigger hull carried at one side of said main hull, a seat on said main hull facing said outrigger hull, and an oar support supported for transverse sliding movement across said watercraft in the area between said main and said outrigger hulls, an oar supported for pivotal movement upon said oar support, said oar having a handle accessible by an operator on said seat for propelling said watercraft, said oar support moving transversely across said watercraft in said area between said main and outrigger hulls upon stroking motion of said oar.

43. A self-propelled watercraft as set forth in claim 42 wherein the oar support comprises a carriage extending from an area beneath the seat transversely across the watercraft toward the outrigger hull and carrying an oarlock thereon.

44. A self-propelled watercraft as set forth in claim 43 further including a pair of cross beams for fixing the outrigger hull to the main hull, the carriage further including a rigger and stay angularly disposed to each other and extending from opposite ends of the carriage and carrying the oarlock.

45. A self-propelled watercraft as set forth in claim 43 wherein the oar support further includes a footrest on which the rider may place his feet carried by the oar support for permitting the rider to extend and withdraw his legs upon rowing action.

46. A self-propelled watercraft as set forth in claim 42 wherein the main hull provides more than 50% of the total buoyancy of the watercraft.

47. A self-propelled watercraft as set forth in claim 46 wherein the main hull is hollow and provides an internal storage area for containing articles.

48. A self-propelled watercraft as set forth in claim 46 wherein the main and outrigger hulls are elongated narrow hulls having a length to beam ratio of approximately twenty and wherein the outrigger hull is substantially shorter than the main hull.

49. A self-propelled watercraft as set forth in claim 48 wherein the oar support comprises a carriage extending from an area beneath the seat transversely across the watercraft toward the outrigger hull and carrying an oarlock thereon.

50. A self-propelled watercraft as set forth in claim 49 further including a pair of cross beams for fixing the outrigger hull to the main hull, the carriage further including a rigger and stay angularly disposed to each other and extending from opposite ends of the carriage and carrying the oarlock.

51. A self-propelled watercraft as set forth in claim 49 wherein the oar support further includes a footrest on which the rider may place his feet carried by the oar support for permitting the rider to extend and withdraw his legs upon rowing action.

52. A self-propelled watercraft as set forth in claim 42 wherein the oar includes a pivotally supported blade at an end thereof for operating in a fin line manner, said blade being submerged during the entire rowing activity.

53. A self-propelled watercraft as set forth in claim 52 wherein the oar support comprises a carriage extending from an area beneath the seat transversely across the watercraft toward the outrigger hull and carrying an oarlock thereon.

54. A self-propelled watercraft as set forth in claim 53 further including a pair of cross beams for fixing the outrigger hull to the main hull, the carriage further including a rigger and stay angularly disposed to each other and extending from opposite ends of the carriage and carrying the oarlock.

55. A self-propelled watercraft as set forth in claim 53 wherein the oar support further includes a footrest on which the rider may place his feet carried by the oar support for permitting the rider to extend and withdraw his legs upon rowing action.

56. A self-propelled watercraft as set forth in claim 52 wherein the main hull provides more than 50% of the total buoyancy of the watercraft.

57. A self-propelled watercraft as set forth in claim 56 wherein the main hull is hollow and provides an internal storage are for containing articles.

58. A self-propelled watercraft as set forth in claim 56 wherein the main and outrigger hulls are elongated narrow hulls having a length to beam ratio of approximately twenty and wherein the outrigger hull is substantially shorter than the main hull.

59. A self-propelled watercraft as set forth in claim 58 wherein the oar support comprises a carriage extending from an area beneath the seat transversely across the watercraft toward the outrigger hull and carrying an oarlock thereon.

60. A self-propelled watercraft as set forth in claim 59 further including a pair of cross beams for fixing the outrigger hull to the main hull, the carriage further including a rigger and stay angularly disposed to each other and extending from opposite ends of the carriage and carrying the oarlock.

61. A self-propelled watercraft as set forth in claim 59 wherein the oar support further includes a footrest on which the rider may place his feet carried by the oar support for permitting the rider to extend and withdraw his legs upon rowing action.

* * * * *